US010383466B2

(12) United States Patent
Wilmarth

(10) Patent No.: US 10,383,466 B2
(45) Date of Patent: Aug. 20, 2019

(54) ADJUSTABLE SPINE ALIGNMENT PILLOW

(71) Applicant: David Wilmarth, Anchorage, AK (US)

(72) Inventor: David Wilmarth, Anchorage, AK (US)

( * ) Notice: Subject to any disclaimer, the term of this patent is extended or adjusted under 35 U.S.C. 154(b) by 24 days.

(21) Appl. No.: 15/423,902

(22) Filed: Feb. 3, 2017

(65) Prior Publication Data

US 2018/0028001 A1 Feb. 1, 2018

Related U.S. Application Data

(60) Provisional application No. 62/367,224, filed on Jul. 27, 2016.

(51) Int. Cl.
*A47G 9/10* (2006.01)
*A47C 20/02* (2006.01)

(52) U.S. Cl.
CPC ..... *A47G 9/1081* (2013.01); *A47C 20/02* (2013.01); *A47C 20/025* (2013.01); *A47C 20/027* (2013.01)

(58) Field of Classification Search
CPC ..... A47G 9/00; A47G 9/10; A47C 20/027; A47C 20/025; A47C 16/005
See application file for complete search history.

(56) References Cited

U.S. PATENT DOCUMENTS 1,385,355 A * 7/1921 Banks ..... A47G 9/10 5/636
2,562,725 A * 7/1951 Leto ..... A47C 20/025 5/631
2,765,480 A * 10/1956 Mueller ..... A47C 7/021 5/630
3,667,074 A * 6/1972 Emery ..... A47G 9/109 5/636
4,031,578 A * 6/1977 Sweeney ..... A47C 7/383 5/426
5,016,303 A 5/1991 Tanaka et al.
5,033,137 A 7/1991 Pedrow
5,038,432 A 8/1991 Robillard et al.
5,182,828 A * 2/1993 Alivizatos ..... A47C 20/025 5/631
5,987,676 A 11/1999 Littleford et al.
6,971,715 B2 * 12/2005 Hankins ..... B62J 1/20 280/304.4
7,086,101 B2 * 8/2006 Welch ..... A47D 7/04 5/425

(Continued)

*Primary Examiner* — Peter M. Cuomo
*Assistant Examiner* — Ifeolu A Adeboyejo
(74) *Attorney, Agent, or Firm* — Global Intellectual Property Agency, LLC; Daniel Boudwin

(57) ABSTRACT

An adjustable spine alignment pillow for improving a user's by encouraging the spinal alignment of the back. The pillow includes a first side connected to a second side via a recessed central portion wherein the recessed central portion is compartmentalized. The pillow casing comprises a plurality of pockets, wherein a first pocket is disposed on the first side and the second pocket is disposed on the second side. The recessed central portion bisects the first side and the second side, wherein the recessed central portion includes a thickness less than a thickness of either the first pocket or the second pocket, wherein the recessed central portion is dimensioned to receive the head of a user in a supine position lying thereon. The apertures are sealed with a fastener to allow for the adding or removing of stuffing into the pillow, thereby allowing for adjustments in firmness.

7 Claims, 4 Drawing Sheets

(56) References Cited

U.S. PATENT DOCUMENTS

| | | | | |
|---|---|---|---|---|
| 7,975,336 | B1 * | 7/2011 | Perry | A47C 20/027 5/636 |
| 8,707,485 | B1 | 4/2014 | Conley | |
| 9,168,192 | B2 * | 10/2015 | Verde Sanchez | A61G 7/072 |
| 2005/0138733 | A1 | 6/2005 | Riesberg et al. | |
| 2005/0217029 | A1 * | 10/2005 | Funatogawa | A47G 9/10 5/645 |
| 2006/0123547 | A1 * | 6/2006 | Ferber | A47G 9/0253 5/636 |
| 2013/0031723 | A1 * | 2/2013 | Parnham | A47G 9/1081 5/645 |

* cited by examiner

ADJUSTABLE SPINE ALIGNMENT PILLOW

CROSS REFERENCE TO RELATED APPLICATIONS

This application claims the benefit of U.S. Provisional Application No. 62/367,224 filed on Jul. 27, 2016. The above identified patent application is herein incorporated by reference in its entirety to provide continuity of disclosure.

BACKGROUND OF THE INVENTION

The present invention relates to an adjustable spine alignment pillow. More specifically, the present invention includes a first side connected to a second side via a recessed central portion, along with a plurality of pockets.

It can be uncomfortable for many people to sleep on their back, as it can place undue stress on their shoulders, neck, and spine. Though pillows tend to provide comfort, the majority of pillows do not properly support the space beneath your neck when you lie on your back. This causes the curling of a user's neck and head forward which is an awkward position for the neck and head and can cause severe discomfort, misalignment of the spine, and can make a user frequently change their position, resulting in restless sleep. In order for a spine to be properly aligned when lying on a pillow, the individual's neck must lie in the same horizontal plane as their head and back. Prolonged spinal misalignment causes health issues, such as continuous pain in an individual's neck, shoulders, and back.

Additionally, it is difficult for many people to find a pillow having the proper fullness or thickness to support their body in a desired manner. If the pillow is too high, the neck is bent abnormally forward causing muscle strain on the back of the neck and shoulders. Thus, there is a need for a pillow where a user can adjust the pillow according to his or her needs, that enables a user to align his or her neck in the same horizontal plane as their head and back when resting their head thereon, and that overall provides a user a pillow that aids in the alignment of the spine thereby improving sleeping.

SUMMARY OF THE INVENTION

In view of the foregoing disadvantages inherent in the known types of adjustable spine alignment pillows now present in the prior art, the present invention provides a new adjustable spine alignment pillow wherein the same can be utilized for providing convenience for the user when the user's head is aligned in the same horizontal plane as their back when the user rests their head thereon, thereby facilitating the alignment of the user's spine. The present system comprises a pillow casing including a first side connected to a second side via a recessed central portion wherein the recessed central portion is compartmentalized. The pillow casing comprises a plurality of pockets, wherein a first pocket is disposed on the first side and the second pocket is disposed on the second side. The recessed central portion bisects the first side and the second side, wherein the recessed central portion includes a thickness less than a thickness of either the first pocket or the second pocket, wherein the recessed central portion is dimensioned to receive the head of a user in a supine position lying thereon.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
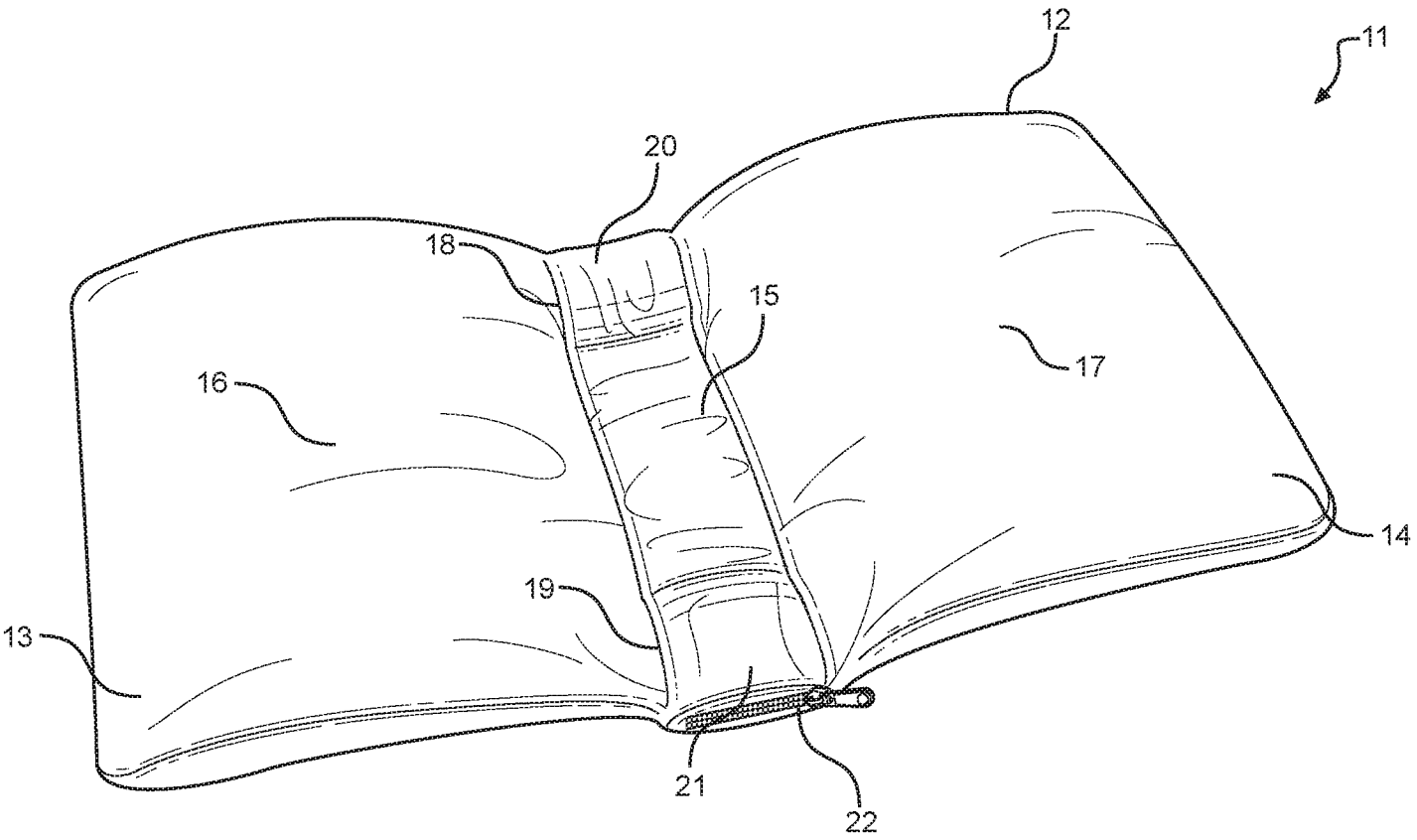
FIG. 1 shows a front perspective view of the adjustable spine alignment pillow.

Reference is made herein to the attached drawings. Like reference numerals are used throughout the drawings to depict like or similar elements of the adjustable spine alignment pillow. The figures e intended for representative purposes only and should not be considered to be limiting in any respect.

Figure 2:
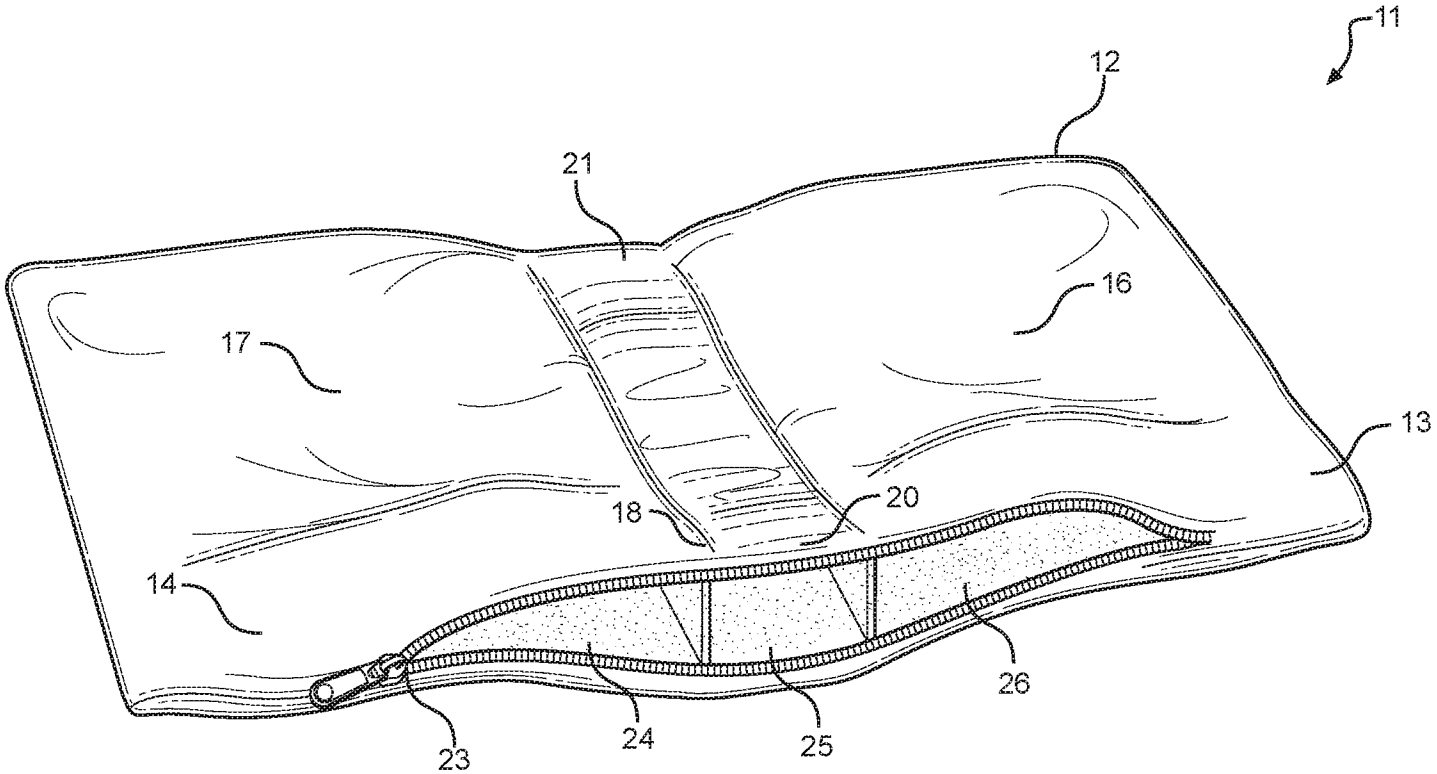
FIG. 2 shows a rear perspective view of the adjustable spine alignment pillow.

Referring now to FIGS. 1 and 2, there is shown a front perspective view and a rear perspective view of the adjustable spine alignment pillow, respectively. The adjustable spine alignment pillow 11 comprises a pillow casing 12 including a first side 13 connected to a second side 14 via a recessed central portion 15 wherein the recessed central portion 15 is compartmentalized. The pillow casing 12 comprises a plurality of pockets, wherein a first pocket 16 is disposed on the first side 13 and the second pocket 17 is disposed on the second side 14. The recessed central portion 15 bisects the first side 13 and the second side 14, wherein the recessed central portion includes a thickness less than a thickness of either the first pocket 13 or the second pocket 14, wherein the recessed central portion 15 is dimensioned to receive a head of a user in a supine position lying thereon. In the illustrated embodiment, the pillow casing 12 comprises a rectangular shape. However, in alternate embodiments, the pillow casing 12 is any suitable shape, such as circular. The pillow casing 12 is composed of any flexible material adapted to conform to the shape of an object placed thereon.

Figure 3:
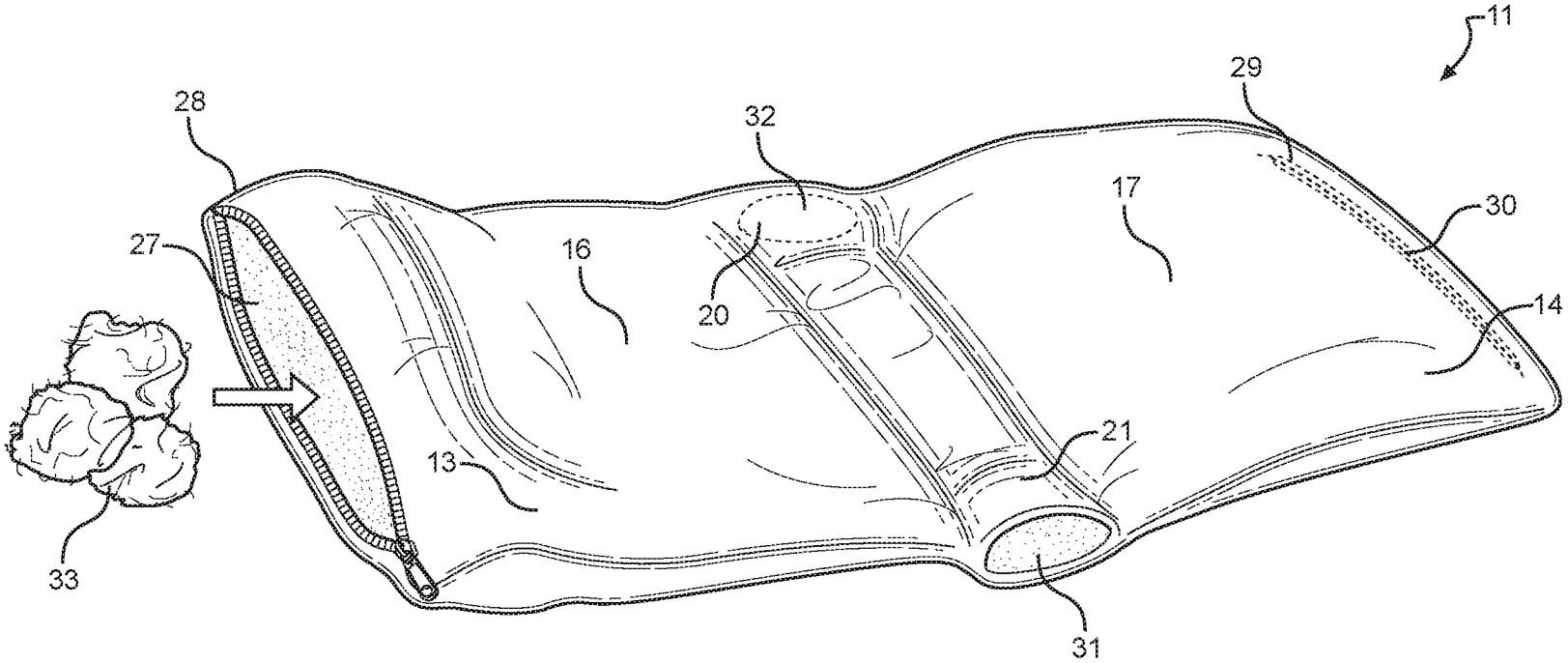
FIG. 3 shows a front perspective view of an alternate embodiment of the adjustable spine alignment pillow.

The first side 13 and second side 14 each contain a plurality of pockets. In the illustrated embodiment, a first pocket 16 is disposed on the first side 13 and a second pocket 17 is disposed on the second side 14. The first pocket 16 and the second pocket 17 both extend the entire portion of the respective side. The first side 13 contains a first aperture 26 that provides access to the interior of the first pocket 16. The second side 14 contains a second aperture 24 that provides access to the interior of the second pocket 17. In the illustrated embodiment, the apertures 24, 26 are positioned in line with the distal end of the first end 18 to provide access to the pockets 17, 16, respectively. The pockets 16, 17 are configured to receive a stuffing 33, as seen in FIG. 3, for allowing a user to selectively achieve a desired fullness or thickness of the pockets 16, 17 to achieve proper spinal alignment. However, in alternate embodiments, the apertures 24, 26 are positioned in a different area on the sides 13, 14, such as between the first side 13 and the first end 18 or between the second side 14 and the first end 18. In the illustrated embodiment, the sides 13, 14 comprise rectangular shapes. However, in alternate embodiments, the sides 13, 14 are any suitable shape, such as circular. The sides 13, 14 are connected by a recessed central portion 15.

The recessed central portion 15 comprises a first end 18 and a second end 19 and an unstuffed section disposed between the first and second ends 18, 19, respectively. The first end 18 comprises a third aperture 25 that provides access to the interior of a third pocket 20. The second end 19 comprises a fourth aperture 31, as seen in FIG. 3, that provides access to the interior of a fourth pocket 21. In the illustrated embodiment, the third aperture 25 is positioned along the entire length of the distal end of the first end 18 and the fourth aperture 31 is positioned along the entire length of the distal end of the second end 19 to allow the apertures to be stuffed or unstuffed. The third pocket 20 begins at the third aperture 25 and extends to the proximal end of the first end 18. The fourth pocket 21 begins at the fourth aperture 31 and extends to the proximal end of the second end 19 where the recessed central portion 15 is unstuffed.

The unstuffed section disposed between the first end 18 and the second end 19 of the recessed central portion 15 is rectangular in shape and provides a placement for the user's head, wherein the user's head is supported by the unstuffed section with a mattress. The unstuffed section of the recessed central portion 15 is dimensioned to receive the head of a user in a supine position lying thereon while keeping the head on the same horizontal plane as the back, in a similar horizontal plane as when standing erect.

The pockets 20, 21 are configured to be stuffed or unstuffed for allowing a user to selectively achieve a desired fullness or thickness of the pockets 20, 21 to achieve proper head and neck support, wherein the pockets 20, 21 support the curvature of the spine at the neck. However, in alternate embodiments, the aperture 25 and the aperture 31 are positioned on a different area on the pillow casing 12, such as between the recessed central portion 15 that is unstuffed and the proximal end of the first end 18 or between the recessed central portion 15 that is unstuffed and the proximal end of the second end 19.

In the illustrated embodiment, the sides 13, 14 comprise rectangular shapes. However, in alternate embodiments, the sides 13, 14 are any suitable shape, such as circular. The pockets 16, 17, 20, 21 are compartmentalized in order to be stuffed in specific pockets to allow for adjustments in firmness wherever a user desires. In operation, the pockets 16, 17, 20, 21 are stuffed such that a user's head is aligned in the same horizontal plane as their back when the user rests their head thereon, thereby facilitating the alignment of the user's spine.

The second end 19 contains a first fastener 22 configured to seal the fourth aperture 31, as seen in FIG. 3. The first end 18 contains a second fastener 23 configured to seal the second aperture 24, third aperture 25, and first aperture 26, as seen in FIG. 2. In the illustrated embodiment, the first fastener 22 is disposed along the entire length of the distal end of the second end 19. The second fastener 23 is disposed along the entire length of the distal end of the first end 18 and extends in both directions parallel to the sides 13, 14. In operation, the second fastener 23 exposes apertures 24, 25, 26 to allow the apertures to be stuffed or unstuffed. The fasteners 22, 23 are positioned along the distal ends of the ends 19, 18, respectively, to provide better comfort and convenience opposed to having the fasteners where a user would place their head which would cause discomfort. However, in alternate embodiments, the fasteners 22, 23 could be placed on different areas of the pillow casing 12, such as between the unstuffed section in the recessed central portion 15 and the proximal end of the first end 18 and the second end 19. In the illustrated embodiment, the fastener is a zipper. However, in alternate embodiments, any suitable fastener is appropriate such as Velcro, buttons, magnets, or any other type of closure device.

Referring now to FIG. 3, there is shown a perspective view of an alternate embodiment of the adjustable spine alignment pillow. The adjustable spine alignment pillow 11 comprises a pair of apertures 27, 30 disposed at the distal end of each of the sides 13, 14, respectively. The fifth aperture 27 provides access to the interior of the first pocket 16 and the sixth aperture 30 provides access to the interior of the second pocket 17. In the illustrated embodiment, the first side 13 is identical to the second side 14. The pockets 16, 17 are configured to add or remove the stuffing 33 for allowing a user to selectively achieve a desired fullness or thickness of the pockets 16, 17 to achieve proper spinal alignment. The stuffing 33 consists of cotton, synthetic material, foam, or any similar type of material. The apertures 27, 30 are disposed at the distal end of each of the sides 13, 14, respectively, to provide a larger opening for stuffing the pockets 16, 17.

The first pocket 16 contains a third fastener 28 configured to seal the fifth aperture 27 and the second pocket 17 contains a fourth fastener 29 configured to seal the sixth aperture 30. In the illustrated embodiment, the third fastener 28 extends along the entire length of the fifth aperture 27 and the fourth fastener 29 extends along the entire length of the sixth aperture 30. The fasteners 28, 29 are disposed on the distal ends of the sides 13,14 to provide better comfort and convenience as opposed to having the fasteners where a user would place their head which would cause discomfort. The third pocket 20 contains a seventh aperture 32 to provide access to the interior of the third pocket 20. However, in an alternate embodiment the pockets may be positioned in different areas of the pillow such as two pockets in each side 13, 14 instead of one.

Figure 4:
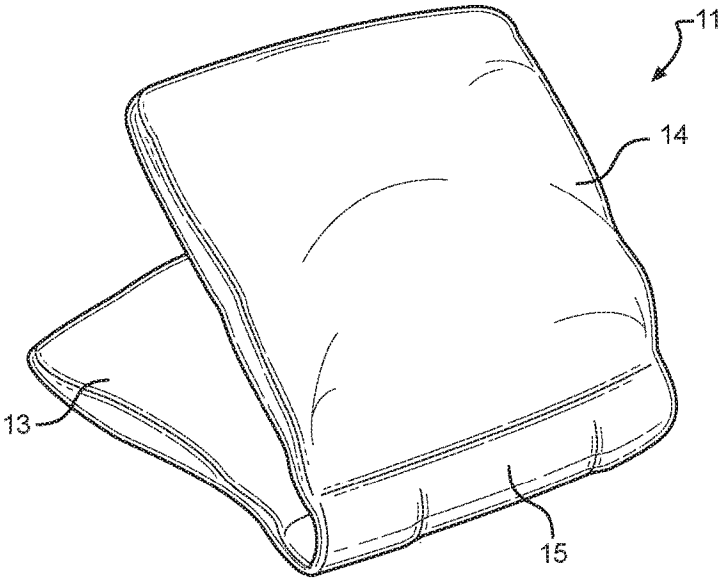
FIG. 4 shows a folded view of the adjustable spine alignment pillow.

Referring now to FIG. 4, there is shown a folded view of the adjustable spine alignment pillow. The recessed central portion 15 includes a flexible juncture configured to selectively allow the first side 13 and the second side 14 to fold thereacross while maintaining its shape. This allows for the user to support themselves for reading or watching television. In the illustrated embodiment, the recessed central portion is void of the stuffing. The recessed central portion 15 is composed of any flexible material adapted to conform to the shape of an object placed thereon. In an alternate embodiment, the recessed central portion 15 includes a semi rigid panel that allows the sides 13, 14 to remain in a stacked configuration. In alternate embodiments, the unstuffed section in the recessed central portion 15 is stuffed, but with less of the stuffing 33 in order to create the recessed central portion 15.

Figure 5:
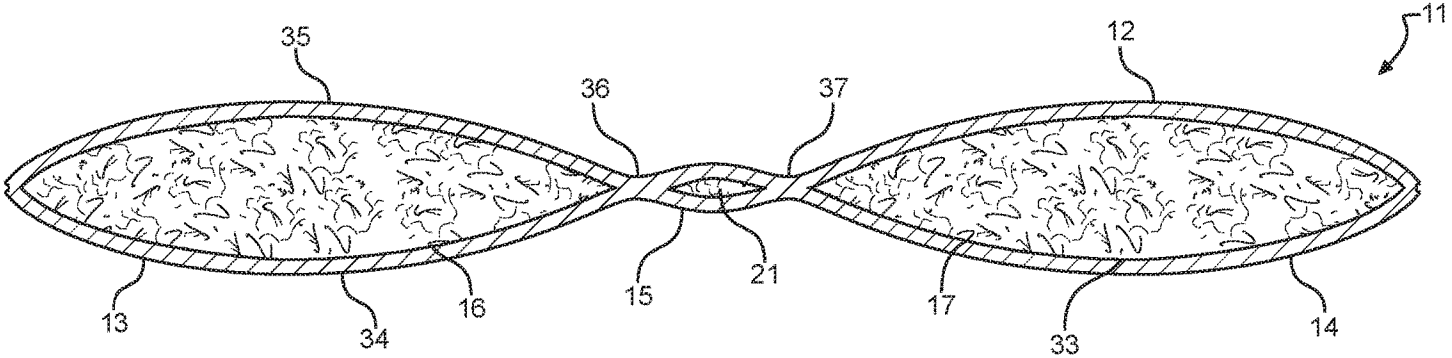
FIG. 5 shows a cross sectional view across the three pockets of the adjustable spine alignment pillow.

Referring now to FIG. 5, there is shown a cross sectional view across the three pockets of the adjustable spine alignment pillow. The pillow casing 12 is the entire perimeter of the adjustable spine alignment pillow 11. The pockets 16, 17, 21 are enclosed by the pillow casing 12 wherein the pillow casing 12 is sewn at a first point 36 and a second point 37 to separate the pockets 16, 17, 21. The first side 13 contains the first pocket 16, and the second side 14 contains the second pocket 17. The recessed central portion 15 contains pocket 21 therein. The first pocket 16 and the second pocket 17 are thicker than the recessed central portion 15 wherein thickness is measured from the lower side 34 to the upper side 35 of the pillow casing 12. In the illustrated embodiment, the stuffing 33 is stuffed throughout the pockets 16, 17, 21. The pockets 16, 17 are thicker to provide more support in order to keep the user's head aligned in the same horizontal plane as their back. In the illustrated embodiment, the pockets 16, 17 each comprise the stuffing 33 such that the pockets 16, 17 are at a uniform height with one another, thereby providing for the same horizontal plane.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable spine alignment pillow, comprising:

a pillow casing including a first side connected to a second side via a recessed central portion, wherein the recessed central portion is compartmentalized;

a plurality of pockets that includes a first pocket, a second pocket, a third pocket, and a fourth pocket, wherein the first pocket is disposed in the first side and the second pocket is disposed in the second side;

wherein the recessed central portion bisects the first side and the second side of the pillow casing, wherein the recessed central portion includes a first end and a second end, wherein the first end includes the third pocket and the second end includes the fourth pocket;

wherein the third pocket and the fourth pocket each occupies less than half the recessed central portion, such that upon insertion of a stuffing into each pocket of the plurality of pockets the recessed central portion includes an unstuffed section disposed between the first end and the second end thereof, wherein the unstuffed section includes a thickness less than a thickness of either the first pocket or the second pocket;

wherein a firmness of each pocket of the plurality of pockets is adjustable by insertion and removal of stuffing therein and therefrom, respectively;

wherein the recessed central portion is dimensioned to receive a head of a user in a supine position lying thereon, such that upon receipt of the head of the user by the recessed central portion, the head of the user is aligned with a spine of the user.

2. The adjustable spine alignment pillow of claim 1, wherein the pillow casing has a rectangular shape.

3. The adjustable spine alignment pillow of claim 1, wherein the recessed central portion includes a flexible juncture configured to selectively allow the first side and the second side to fold thereacross.

4. The adjustable spine alignment pillow of claim 1, wherein the second end comprises a first fastener.

5. The adjustable spine alignment pillow of claim 4, wherein the first fastener is disposed on a distal end of a selection of pockets of the plurality of pockets, wherein the first fastener is configured to seal the selection of pockets of the plurality of pockets, wherein the selection includes the first pocket, the second pocket, and the third pocket.

6. The adjustable spine alignment pillow of claim 1, wherein the plurality of pockets is compartmentalized.

7. The adjustable spine alignment pillow of claim 1, wherein each pocket of the plurality of pockets includes an aperture configured to enable the insertion and removal of the stuffing therein and therefrom, respectively.

* * * * *